United States Patent [19]

Egan, Jr.

[11] Patent Number: 4,961,555

[45] Date of Patent: Oct. 9, 1990

[54] GLASS HOLDER

[75] Inventor: Edward J. Egan, Jr., Pasadena, Calif.

[73] Assignee: West Coast Container, Huntington Park, Calif.

[21] Appl. No.: 405,646

[22] Filed: Sep. 11, 1989

[51] Int. Cl.[5] ..... A47G 21/00

[52] U.S. Cl. ..... 248/231.8; 211/41; 220/23.83; 248/311.2; 248/314; 248/315

[58] Field of Search ..... 248/311.2, 314, 315, 248/231.8; 211/41; 220/85 H, 23.83

[56] References Cited

U.S. PATENT DOCUMENTS

| | | | |
|---|---|---|---|
| 1,063,321 | 6/1913 | Blackwell | 220/23.83 |
| 1,987,896 | 1/1935 | Ericsson | 220/23.83 X |
| 2,307,882 | 1/1943 | Freud et al. | 248/311.2 X |
| 2,413,535 | 12/1946 | Weidler | 248/231.8 X |
| 2,719,414 | 10/1955 | Davis | 248/311.2 X |
| 3,115,251 | 12/1963 | Farrell | 211/41 |
| 3,379,331 | 4/1968 | Kamlet | 220/23.83 |
| 4,629,153 | 12/1986 | Marcum | 248/311.2 X |
| 4,696,447 | 9/1987 | Stecker | 248/314 X |

FOREIGN PATENT DOCUMENTS

| | | | |
|---|---|---|---|
| 477509 | 12/1937 | United Kingdom | 220/23.83 |

*Primary Examiner*—David L. Talbott
*Attorney, Agent, or Firm*—Marvin E. Jacobs

[57] ABSTRACT

A stemware holder for engaging the rim of a plate comprising a slotted bowl for receiving a stemware. A flange is attached to the top of the bowl. Two bent clip elements attached to the edge of the flange and a lower clip element is attached to the bottom of the bowl. An L-shaped gusset connects the top clip elements to the bottom element stiffening the clips and moving the flex point from the juncture with the flange to the bends in the clip. This strengthens the clips and permits wider flexing to receive thicker plates without cracking or breaking.

7 Claims, 2 Drawing Sheets

GLASS HOLDER

TECHNICAL FIELD

The invention relates to stemware holders and, more particularly, to stemware holders which clip onto the edges of plates to free a user's stemware holding hand for other uses, such as to use eating utensils, shake hands, and the like.

BACKGROUND OF THE INVENTION

At many cocktail parties and buffet dinners, guests are required to simultaneously hold beverages while eating snacks or meals, either standing or sitting down. Much of the time a horizontal surface upon which a drink may be placed, such as a table top, is inconvenient to reach or unavailable. Frequently, the drinking vessel used is stemware, either brass or plastic. It is very difficult for most people to hold a liquid containing drinking vessel and eat from a hand or lap-held plate at the same time without appearing awkward or spilling some of the contents of the glass or the plate. Attempts have been made to alleviate the problem of literally not having enough hands under such conditions.

List of Prior Art

| U.S. Pat. No. | Patentee |
|---|---|
| D 31,665 | J. L. McKay |
| D281,565 | V. Stourton et al. |
| 1,258,792 | R. H. Lorimer |
| 2,307,882 | J. Freud et al. |
| 2,413,535 | W. Weidler |
| 2,427,697 | W. Weidler |
| 2,643,046 | J. A. Humphreys |
| 2,719,414 | J. H. Davis |
| 2,916,180 | J. Alger |
| 3,036,717 | R. N. Johnson |

McKay discloses a spoon holder having 3 dish engaging fingers. Lorimer shows a plate-engaging cup clasps formed of shaped metal wire. Freud et al.'s combined food and beverage server has a hoop with clips for engaging a plate. A cup holder is connected to the hoop. The cup or glass holder illustrated by Weidler ('535) comprises a spring wire assembly engaging the bottom surface of a plate and connected to a loop above the plate for receiving a glass. Weidler ('697) shows a similar arrangement formed of cardboard or pressed fiber. Humphreys discloses a clamp for holding several items. Alger discloses a refreshment slate supporting frame having a cup holder. Johnson's mug tray clips onto a vertical surface such as the edge of a car window.

The glass holders most useful for a cocktail party are the ones shown in the Davis and Stourton patents. These patents disclose cup and glass holders which are detachably secured to plates by an opposed set of spring prong members angled the same orientation as the rim of a plate. These devices use an upper prong member and two lower prongs attached to the edge of the cup supporting bowl.

A commercial form of this type of device formed from plastic has recently been marketed as the PLATE MATE. The PLATE MATE device includes a slotted cup holding bowl having a flange connected to a three pronged clip which extends laterally therefrom. While this device is serviceable as far as its slotted bowl structure is concerned, its clip is insufficiently durable and breaks with use. The PLATE MATE was apparently designed for use with thin dinner ware and fine China since as soon as the rim of thick dinnerware is placed between the three prong members, the upper wide prong tends to crack and split along the line connecting it to the flange at the top of cup bowl.

One reason for the failure of the upper prong is that the device uses a single central upper prong element to provide most of the support for the stemware, which can be quite heavy if it is made of glass or lead crystal and is full or nearly full of wine. Secondly, the upper prong element is limited to being a single flat bar, not otherwise braced or reinforced while supporting a heavy load extending far from the lip of the bowl. The force of the weight is concentrated at the pivot-juncture of the prong with the flange and therefore breaks after some use at this juncture.

STATEMENT OF THE INVENTION

The present invention provides a strong, serviceable and attractive clip-on stemware holder suitable for use on fine china, thicker pottery style plates, as well as disposable plastic and paper plates. The stemware holder of the invention is not subject to failure at the juncture of the flange and prongs. The stemware holder of the invention is easy to use and is readily manufactured by injection molding. The holder is attractive to use with fine china and pottery and reliably holds a drink while it is suspended from the rim of a plate.

In accordance with the invention there is provided a clip-on stemware holder comprising a slotted, bowl-shaped structure for holding stemware, the bowl shaped structure having a flange circumferentially disposed about it. A spaced pair of upper clip elements adapted to supportively and frictionally engage the upper surface of a plate upon which said holder is to be mounted extend from the flange. A lower clip element extends from the bowl substantially parallel to the upper clip elements and spaced therebeneath a selected amount. The lower clip element is circumferentially disposed in the space between the spaced upper clip elements and is adapted to supportively and frictionally engage the lower surface of a plate upon which the holder is to be mounted.

The stemware holder preferably further comprises bracing members, such as one or more gussets, to strengthen the juncture of the lower clip element and the slotted bowl shaped structure. The gussets are preferably aligned essentially vertically with respect to the position of use of the stemware holder. The lower clip element is preferably generally L-shaped, having a base portion extending downwardly from the flange and a body portion extending outwardly and substantially perpendicularly from the base portion and the one or more gussets extend between the bowl shaped structure and the base portion of the L-shaped lower clip element. Preferably, two gusset members and the base portion of the lower clip element form a hollow U-shaped channel with the gussets forming the sides of the U and the base portion of the lower lip element the base of the U to provide a strong juncture of the lower clip and the bowl shaped stemware holding structure. The upper and lower clip elements may have friction pads disposed thereon to engage and hold the stemware holder to a plate.

The present invention provides safe and secure stemware holding on a variety of plates of different configurations and thicknesses for a user having no readily accessible resting surface for his drinking vessel.

Additional advantages and novel features of the invention will be set forth in part in the description which follows, and in part will become apparent to those skilled in the art upon examination of the following or may be learned by practice of the invention. The advantages and features of the invention may be realized and attained by means of the instrumentalities and combinations particularly pointed out in the appended claims.

BRIEF DESCRIPTION OF THE DRAWINGS

The accompanying drawings, which are incorporated in and forms a part of the specification, illustrate several embodiments of the present invention and, together with the description, serve to explain the principles of the invention. In the drawings.

DETAILED DESCRIPTION OF A PREFERRED EMBODIMENT OF THE INVENTION

Figure 1:
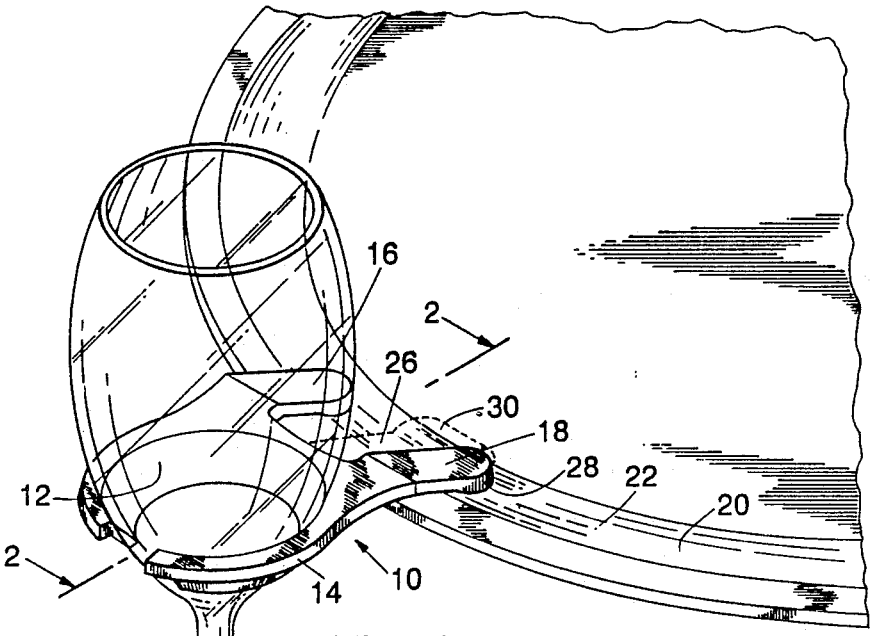
FIG. 1 illustrates a preferred embodiment of the invention in use clipped onto a plate.

Reference is now made to FIG. 1 which illustrates a preferred embodiment of the invention in use, shown clipped onto a dinner plate. The device 10 is preferably made of a somewhat flexible plastic or tough elastomer and comprises a slotted bowl shaped structure 12 having a flange 14 circumferentially disposed thereabout and extending radially outwardly therefrom. Although the flange 14 is positioned about the lip of the bowl shaped structure in the preferred embodiment and projects radially outwardly therefrom, those skilled in the art will recognize that the flange may be located around the bowl further down, such as about its middle, or even about its base and project radially outwardly therefrom. A pair of spaced apart upper clip elements 16 and 18 are attached to and extend from the flange 14 and frictionally and supportively engage the top surface 20 of the rim of a plate 22. The lower surface 24 of the rim of plate 20 is frictionally and supportively engaged by a lower clip element 26 being attached to and extending from flange 14. A slot 27 through the bowl shaped structure 12 and flange 14 thereon is located on a side of the structure 12 opposite from the side where the upper clip elements 16, 18 and lower clip element 26 are located and attached to the flange 14 of the structure 12.

Figure 2:
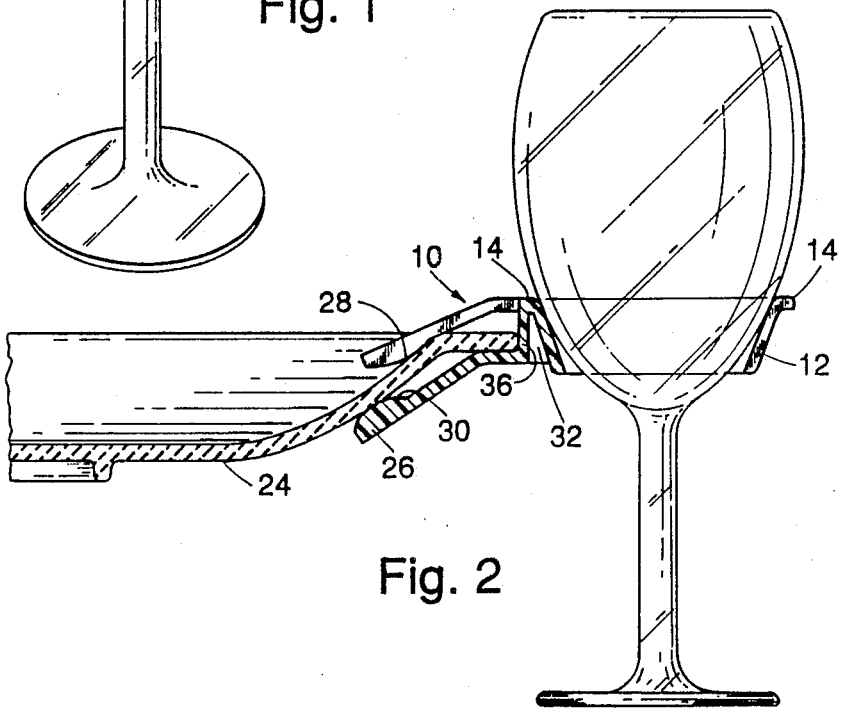
FIG. 2 is a cutaway cross sectional view of the preferred embodiment in use.

As seen in FIG. 2, the clip elements 16, 18 and 26 of the preferred embodiments have friction pads 28 and 30, respectively, molded thereon. Preferably the pads have rounded surfaces. The friction pads can comprise the same substance as that from which the device 10 is manufactured, or may comprise other substances such as a softer rubber or plastic.

Figure 3:
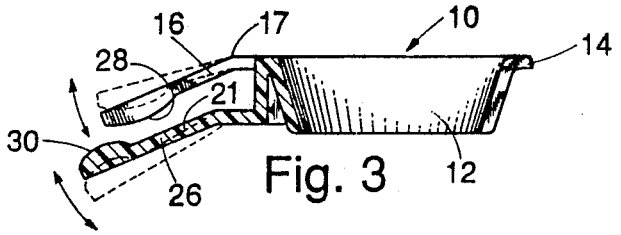
FIG. 3 shows the flexible clips of the preferred embodiment.

FIG. 3 shows the springlike flexibility of the clip elements 16, 18 and 26 of the device 10 which is useful for attaching the device onto a plate as well as removing it therefrom. The stiffness provided by the gussets 32, 34 changes the flex point to the bends 17, 19, 21 rather than the juncture with the flange. The clips 16, 18 and 26 can flex widely without cracking or splitting. The flexibility of the clips elements of the device make it suitable for use on plates of various thicknesses.

Figure 5:
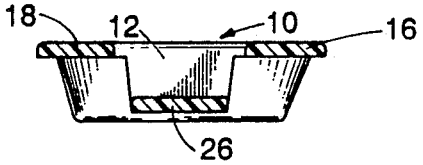
FIG. 5 is a cutaway side view of the preferred embodiment.

FIG. 5 is a cutaway view of clip elements 16, 18 and 26. Advantageously, two upper circumferentially spaced clip elements are provided in the preferred embodiment to provide good supportive strength on the upper side of the clip which bears the downward force of a drinking vessel, which could be rather substantial if such vessel is a large, lead crystal glass, full to the brim.

Figure 4:
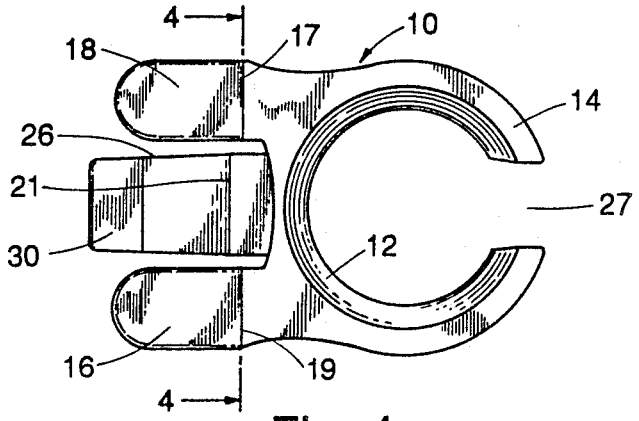
FIG. 4 is a top view of the preferred embodiment.
Figure 6:
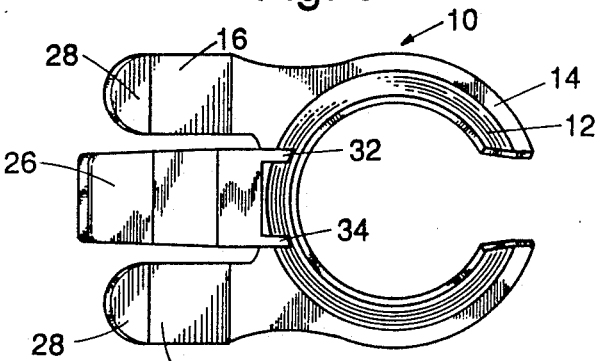
FIG. 6 is a view of the bottom of the preferred embodiment showing the lower clip to slotted bowl juncture support gussets.

FIG. 4 is a top view of the device 10 illustrating the relative positions of the slot 27 and the clip elements 16, 18 and 26. As seen in FIG. 6, gussets 32 and 34 are provided as braces for the generally L-shaped lower clip member 26 which joins flange 14 as best seen in FIG. 2. Gussets 32 and 34 and base portion 36 of lower clip element 26 form a hollow, generally U-shaped channel to provide very good bracing for the lower clip element 26 which can bear substantial force at times. The unique combination of two upper clip elements and a gusseted lower clip element provide a very strong beverage vessel holder far superior to that of the prior art described hereinabove.

The invention has been described in detail with particular reference to a preferred embodiment thereof, but it will be understood that variations and modifications can be effected within the scope of the invention.

I claim:

1. A clip-on stemware holder comprising:

bowl shaped means for holding stemware, said bowl shaped means including a flange circumferentially disposed about and extending radially outwardly from said bowl shaped means;

a pair of laterally-spaced upper clip elements extending from said flange and adapted to supportively and frictionally engage the upper surface of the rim of a plate upon which said holder is to be mounted;

a lower clip element attached to and extending downwardly and then outwardly from said flange of said bowl shaped means, said lower clip element being positioned substantially parallel to said upper clip elements and spaced therebeneath a selected amount, said lower clip element being circumferentially disposed in the space between said spaced upper clip elements, said lower clip element being adapted to supportively and frictionally engage the lower surface of a plate upon which said holder is to be mounted; and means underlaying said flange and extending between and connected to said bowl shaped means and the downwardly extending portion of said lower clip element for bracing said lower clip element to said bowl shaped means.

2. The invention of claim 1 wherein said bracing means comprises support gusset means aligned essentially vertically with respect to the position of use of said stemware holder to provide support for said lower clip element extending from said bowl shaped means.

3. The invention of claim 2 wherein:

said lower clip element is generally L-shaped and comprises a base portion extending downwardly from said flange and spaced outwardly from said bowl shaped means and a body portion extending outwardly and substantially perpendicularly from said base portion; and said gusset means comprises at least one gusset member extending between and attached to said bowl shaped means and said base portion of said L-shaped lower clip element.

4. The invention of claim 3 wherein said gusset means comprises two spaced gusset members.

5. The invention of claim 4 wherein said two gusset members and said base portion of said lower clip element comprise a U-shaped channel with said gusset members forming the sides of the U and said base portion of said lower lip element the base of the U to provide a strong juncture of said lower clip and said bowl shaped stemware holding means.

6. The invention of claim 1 wherein said upper and lower clip elements comprise friction pad means disposed thereon to engage and hold said stemware holder to a plate.

7. The invention of claim 1 wherein said bowl shaped means includes a bowl shaped structure having said flange formed thereon and extending circumferentially about and projecting radially outwardly therefrom, said bowl shaped structure and said flange having a slot formed therethrough at a side thereof opposite from the side at which said upper and lower clip elements are connected to said flange.

* * * * *